US007051377B1

(12) United States Patent
Milner et al.

(10) Patent No.: US 7,051,377 B1
(45) Date of Patent: May 30, 2006

(54) GLOVE HAVING ARTICLE LOCKING MEMBER

(76) Inventors: David R Milner, 176 Pineview Dr., Lakeside, MT (US) 59922; Judy Milner, 176 Pineview Dr., Lakeside, MT (US) 59922

( * ) Notice: Subject to any disclaimer, the term of this patent is extended or adjusted under 35 U.S.C. 154(b) by 0 days.

(21) Appl. No.: 10/944,950

(22) Filed: Sep. 20, 2004

(51) Int. Cl.
*A41D 19/00* (2006.01)

(52) U.S. Cl. ..... 2/159; 2/161.6

(58) Field of Classification Search ..... 2/16, 2/20, 159, 160, 161.1, 161.2, 161.6, 163; 294/25; 482/44, 47–49
See application file for complete search history.

(56) References Cited

U.S. PATENT DOCUMENTS

| | | | | | |
|---|---|---|---|---|---|
| 1,681,389 | A | | 8/1928 | Blake | |
| 2,083,604 | A | | 6/1937 | Hay | |
| 3,105,972 | A | | 10/1963 | Christopher | |
| 3,274,616 | A | | 9/1966 | Russo | |
| 3,348,238 | A | * | 10/1967 | Hydock | 2/161.2 |
| 4,400,831 | A | | 8/1983 | Rietz | |
| 4,720,279 | A | | 1/1988 | Fritschen et al. | |
| 4,793,005 | A | | 12/1988 | Hetzel, Jr. | |
| 5,004,231 | A | | 4/1991 | Alread | |
| 5,182,814 | A | | 2/1993 | Christensen | |
| 5,298,001 | A | * | 3/1994 | Goodson | 482/23 |
| 5,353,440 | A | * | 10/1994 | Meldeau | 2/161.1 |
| 5,435,013 | A | * | 7/1995 | Davis | 2/161.1 |
| 5,517,964 | A | | 5/1996 | Chen et al. | |
| 5,742,942 | A | | 4/1998 | Sykes | |
| 5,809,570 | A | * | 9/1998 | Grover | 2/161.1 |
| 5,845,374 | A | | 12/1998 | Briggs | |
| 5,846,168 | A | * | 12/1998 | Murray | 482/105 |
| 5,898,944 | A | * | 5/1999 | Vrany | 2/161.4 |
| 6,553,576 | B1 | | 4/2003 | Knapp | |
| 6,834,397 | B1 | * | 12/2004 | Murphy | 2/161.1 |

FOREIGN PATENT DOCUMENTS

| | | |
|---|---|---|
| FR | 2.565.213 | 6/1985 |
| FR | 2.656.597 | 5/1991 |

* cited by examiner

*Primary Examiner*—Gary L. Welch
(74) *Attorney, Agent, or Firm*—Michael I Kroll

(57) ABSTRACT

Apparatus for a glove 22 having means 24 for encompassing an article to be gripped. The glove 22 has a planar member 28 extending substantially from the wrist area projecting toward the fingers and curving back towards the palm. The hook-like flap 24 has hook and loop material 30 positioned on the back side that mates with hook and loop material located on the finger tips. In use, the article to be held is positioned between the glove 22 and hook-like member 24 whereupon the hook-like member encompasses a part of the article to be held. Thereafter the fingers are curled until the mating hook and loop member 30 are engaged thereby locking the gloves 22 onto the article to be held. Additionally, means for securing the glove onto the hand using an adjustable wrist strap 26 are disclosed.

9 Claims, 10 Drawing Sheets

GLOVE HAVING ARTICLE LOCKING MEMBER

BACKGROUND OF THE INVENTION

1. Field of the Invention

The present invention relates generally to gloves and, more specifically, to a glove having means for encompassing an article to be gripped. The glove of the present invention has a planar member extending substantially from the wrist area projecting toward the fingers and curving back towards the palm. The hook-like planar member has hook and loop material positioned on the back side that mates with hook and loop material located on the finger tips. In use the article to be held is positioned between the glove and hook-like member whereupon the hook-like member encompasses a part of the article to be held. Thereafter the fingers are curled until the mating hook and loop member are engaged thereby locking the gloves onto the article to be held. Additionally the present invention provides means for securing the glove onto the hand using an adjustable wrist strap.

2. Description of the Prior Art

There are other glove-like devices designed for gripping articles. Typical of these is U.S. Pat. No. 1,681,389 issued to Blake on Aug. 21, 1928.

Another patent was issued to Hay on Jun. 15, 1937 as U.S. Pat. No. 2,083,604. Yet another U.S. Pat. No. 3,105,972 was issued to Christopher on Oct. 8, 1963 and still yet another was issued on Sep. 27, 1966 to Russo as U.S. Pat. No. 3,274,616.

Another patent was issued to Rietz on Aug. 30, 1983 as U.S. Pat. No. 4,400,831. Yet another U.S. Pat. No. 4,720,279 was issued to Fritschen, et al. on Jan. 19, 1988. Another was issued to Hetzel, Jr. on Dec. 27, 1988 as U.S. Pat. No. 4,793,005 and still yet another was issued on Apr. 2, 1991 to Alread as U.S. Pat. No. 5,004,231.

Another patent was issued to Christensen on Feb. 2, 1993 as U.S. Pat. No. 5,182,814. Yet another U.S. Pat. No. 5,517,694 was issued to Fabry on May 21, 1996. Another was issued to Briggs on Dec. 8, 1998 as U.S. Pat. No. 5,845,374 and still yet another was issued on Apr. 28, 1998 to Sykes as U.S. Pat. No. 5,742,942. Another patent was issued to Knapp on Apr. 29, 2003 as U.S. Pat. No. 6,553,576. Yet another was issued to Jausions on Dec. 6, 1985 as French Patent No. FR2565213 and still yet another was issued on Jul. 5, 1991 to Esteban, et al. as French Patent No. FR2656597.

U.S. Pat. No. 1,681,389

Inventor: Belden H. Blake

Issued: Aug. 21, 1928

An article of the character described including a palm portion, straps upon the palm portion arranged to he fastened around the wrist, and a loop upon said palm portion adapted to receive the handle of a club or the like.

U.S. Pat. No. 2,083,604

Inventor: Peter Hay

Issued: Jun. 15, 1937

A golf glove having means for securing the third and fourth fingers thereof in a substantially fist like closed position regardless of the position of the other fingers of said glove.

U.S. Pat. No. 3,105,972

Inventor: John A. Christopher

Issued: Oct. 8, 1963

In means for gripping golf clubs and analogous articles; a glove having a back portion, a palm portion, finger stalls and a thumb area and a wrist; an elastic band secured at one end to said palm portion of said glove adjacent said thumb area and at an inclination from the latter toward said wrist transversely of said palm portion; a first attaching member secured to said back portion of said glove and spaced from said thumb area; and a second attaching member secured to the other end portion of said band and cooperating with said first member for releasably securing said other end portion of said band to said back portion of said glove with said band under tension; said band being of a width to clear the thumb and index finger and to overlie the other fingers of a hand grasping the grip of a golf club, when said band is secured under tension about the hand, leaving the thumb and index finger of the hand free of pressure exerted by said band.

U.S. Pat. No. 3,274,616

Inventor: Allie Russo

Issued: Sep. 27, 1966

A grip locking glove assembly adapted to compel the wearer to retain a firm grip upon the shaft of a golf club when the hands are gripping the club shaft, comprising a glove assembly positioned on a hand of the wearer, said glove assembly including a glove and a swatch of fastening material attached to the back thereof, a resilient band assembly including a band having a mating attachment on one end detachably secured to the swatch of fastening material, said band being wrapped completely around the glove and hand, a second mating attachment on the opposite end of said band detachably fastening into the swatch to hold the gloved hand firmly about the shaft of the golf club.

U.S. Pat. No. 4,400,831

Inventor: Peter W. Rietz

Issued: Aug. 30, 1983

A glove arrangement for water skiing for enabling the water skier to establish through his grip on the tow rope crossbar handle a finger controlled structural purchase that couples, through the glove arrangement, the skeletal structure of his arms to the tow rope handle in bypassing relation to the muscles of his hands and forearms, in which the glove for each hand is a hand cover of the usual finger glove configuration and includes a palm portion and a wrist portion in which a palm side strapping is affixed to the glove on its palm or gripping side that extends across the glove palm portion longitudinally thereof and along and between the glove finger portions and wrist portion on the palm side of same, and has a protuberant rib extending crosswise of the strapping and the finger portions adjacent the area of the first finger joints of the finger portions, which rib in use provides a finger controlled over center type socket forming purchase on the handle, and a wrist strapping anchored to the glove palm side strapping adjacent the glove wrist portion at the palm side of same, and at one end of the wrist strapping, with the wrist strapping being proportioned to be wrapped firmly around the glove wrist portion when the water skier applies the glove to his hand, and with the other end of the wrist strapping and the glove including self adhering means for holding the glove wrist strapping in place while the skier is using the glove.

U.S. Pat. No. 4,720,279

Inventor: Charles L. Fritschen, et al.

Issued: Jan. 19, 1988

A device is disclosed to assist a wearer in firmly gripping the handle(s) of water sports equipment for long periods of time with minimal hand and arm fatigue. The device comprises a grip strap of webbing material, a protuberant rib which extends transversely of the strap, at least one finger-attaching member near the rib at one end of the grip strap, and a wrist strap and fastening means attached to the other end and on the reverse side of the grip strap. The grip is constructed such that when, in use, a wearer's fingers are extended, the palm strap becomes taut between the finger attachment member and the wrist strap such that the wearer's retained fingers are supported in a hooked position. And, when the wearer's hand is curled around a handle, the rib can extend beyond the wearer's fingertips.

U.S. Pat. No. 4,793,005

Inventor: John M. Hetzel, Jr.

Issued: Dec. 27, 1988

A sports glove which includes a glove body, a plurality of open-ended stub fingers, a palm portion made of a flexible material, a flexible strap attached at a fixed end thereof to the palm portion and having a free end fitted with loop material, and a patch of hook material attached to the stub fingers. The strap is looped about a sports implement to be grasped and the free end of the strap is attached to the glove body by the connection formed between the patches of hook and loop material. In use, the tensile force exerted by the implement on the hand of the user bears against the portion of the free end overlapping the hook material to form a secure attachment, so that a portion of the force is borne by the strap and glove palm. The hook and loop connection can be released quickly by the wearer of the glove and involves merely the straightening of the wearer's fingers.

U.S. Pat. No. 5,004,231

Inventor: Don Alread

Issued: Apr. 2, 1991

Apparatus including a glove member formed with a reinforced palm surface underlying a top surface for association of the back of the hand wherein a reinforcing web is mounted overlying the four finger sockets of the glove. A wrist strap is securable to enclose an individual's wrist directed within the glove, and a loop member and a free strap are secured to opposed ends of the wrist strap member to provide an encompassing strap for securement about associated exercise bars. Modifications of the instant invention include finger pockets securable overlying the finger sockets and thumb socket with modifications of the pockets utilizing fluid filled cushions. Weighted bars are optionally securable within pockets formed within free ends of each of the thumb and finger sockets.

U.S. Pat. No. 5,182,814

Inventor: Kenneth Christensen

Issued: Feb. 2, 1993

A weight supporting glove has a flap attached thereto near the heel which extends distally toward the fingertips. The flap is equipped with a Velcro or similar type fastener on its distal end which cooperates with a mating Velcro strip on the palm of the glove. In use, the flap is wrapped around the handle of a barbell or similar weight and fastened to the palm of the glove to form a loop which assists in supporting the weight.

U.S. Pat. No. 5,517,694

Inventor: John J. Fabry

Issued: May 21, 1996

In a radio communication system, a predetermined bias voltage is applied to the base of a transistor in a high-frequency amplifier circuit immediately before the transistor makes its normal operation. When a high-frequency input signal is received under a weak electric field, a control circuit generates a control voltage cc of a high level so that the high-frequency amplifier circuit can operate with its large amplification factor. This control voltage is supplied to the base of the transistor through a diode and a resistor in a current control circuit to be added to the predetermined bias voltage to increase the base current so that the high-frequency amplifier circuit operates with a large amplification factor. On the other hand, when the input signal is received under a strong electric field, the control circuit supplies a control voltage of a low level to the base of the transistor so that the high-frequency amplifier circuit operates with a small amplification factor.

U.S. Pat. No. 5,742,942

Inventor: Philip K. Sykes

Issued: Apr. 28, 1998

A golf club having a configuration adapted to ensure that the gloved, weak hand of the golfer, grasps the club shaft and particularly the gripping area thereof with a sufficient force to adequately secure the club and thus play the game despite the presence of a handicap, including a handicap comprising the total inability to exert any force in a gripping manner. Furthermore, the present invention provides a golf glove configuration which is designed to provide a powerful grasp of the club shaft with the gloved hand for preventing any twisting of the glove upon impact with the ball, despite the presence of large torquing forces resulting from such impact. The invention is essentially identical in shape to all existing golf gloves, but comprises a Velcro hooked strap which is much longer than the conventional Velcro hook strap found in ordinary golf gloves. Furthermore, the golf glove provides surfaces of Velcro loops on the knuckle side of the small finger and of the ring finger, which loops are designed to engage the elongated hook strap in a configuration during grasping. Such engagement locks the weak hand of the golfer around the gripping portion of the golf club shaft in a highly forceful manner which may exceed the inherent capability of the hand musculature.

U.S. Pat. No. 5,845,374

Inventor: Patrick A. Briggs

Issued: Dec. 8, 1998

The invention is a strap for enhancing one's grip on a golf club. To use the strap one places on a golf glove and grips the club. Then one takes the strap which is a piece of material approximately 17 inches long with loop material of hook and loop fabric on the bottom and hook material of hook and loop fabric on the top and virtually "sandwiches" the end of the strap in to the hook and loop material of the glove, giving a solid attachment between the two. Then one begins wrapping the strap around the hand almost perpendicular to the arm and then continues wrapping upward over the little and ring finger and attaches the hook material on the top of the strap to the loop material on the bottom of the strap. This wrapping around the hand enhances one's grip on the club.

U.S. Pat. No. 6,553,576

Inventor: Debra Knapp

Issued: Apr. 29, 2003

A gripping glove comprises a glove body that includes a hand opening, a backing, a palm and finger spaces. Attached to the gripping glove are laces that are capable of being tied together so the glove body can be tied to an object to be gripped. Also, loops are attached to the glove body that are capable of receiving a user's fingertips which allow the user to grip the object. Further included with the gripping glove is a detachable sleeve that allows the user to grip alternative types of objects. The combination of the laces, loops and detachable sleeve allows the user to grip several different types of objects.

French Patent Number FR2565213

Inventor: Henri Jausions

Issued: Dec. 6, 1985

The invention relates to a glove which makes it possible to carry heavy loads equipped with handles or with bars while reducing the gripping force of the fingers. It consists of a conventional glove equipped with a strap fastened at the start of the wrist on the top, and perpendicular to the latter, and closing up slantwise towards the inner part of the hand and towards the front in order to be placed around the bar in the opposite direction from the fingers. This glove will be used advantageously, in addition, for windsurfing and rowing.

French Patent Number FR2656597

Inventor: Christian Esteban, et al.

Issued: Jul. 5, 1991

The invention relates to a device forming a perforated glove for allowing the thumb and the fingers to pass through, and it is composed of three straps, one being completely closed and passing around the hand between the thumb and the fingers, and another strap being open and fastening around the wrist by means of a "Velcro" or clip system—the two straps described above are connected by a wider strap covering over the palm and folded over its entire length, the upper part serving as a keeper (loop) for the strap. A plate is fastened on the strap by means of four rivets and on said plate is fastened, via its axis, by means of two rivets, a blade of metal or another very strong composition, said blade being curved over in order to form a hook, covered with a sheath of flexible plastic or another material in order to prevent wear particularly from ropes. The invention applies to the field of handling lifting gear (the sport of sailing) and to the carrying of buckets and other objects of certain weights.

While these gloves may be suitable for the purposes for which they were designed, they would not be as suitable for the purposes of the present invention, as hereinafter described.

SUMMARY OF THE PRESENT INVENTION

The present invention discloses a glove having means for encompassing an article to be gripped. The glove of the present invention has a planar member extending substantially from the wrist area projecting toward the fingers and curving back towards the palm. The hook-like flap has hook and loop material positioned on the back side that mates with hook and loop material located on the finger tips. In use, the article to be held is positioned between the glove and hook-like member whereupon the hook-like member encompasses a part of the article to be held. Thereafter the fingers are curled until the mating hook and loop member are engaged thereby locking the gloves onto the article to be held. Additionally, the present invention provides means for securing the glove onto the hand using an adjustable wrist strap.

A primary object of the present invention is to provide a glove to assist the wearer in holding onto an article being gripped.

Another object of the present invention is to provide a glove that relieves pressure from the fingers while an article is being gripped.

Yet another object of the present invention is to provide a glove having a planar member extending from the wrist and spaced away from the fingers.

Still yet another object of the present invention is to provide said planar member with a hook-like end.

Another object of the present invention is to provide said hook-like member with one part of a mating fastener.

Yet another object of the present invention is to provide a glove having the other part of a mating fastener fastened to the finger area of said glove.

Still yet another object of the present invention is to provide a glove whereby the fastening elements can be engaged and disengaged by curling and uncurling the fingers.

Additional objects of the present invention will appear as the description proceeds.

The present invention overcomes the shortcomings of the prior art by providing a glove having means for encompassing an article to be gripped. The glove of the present invention has a planar member extending substantially from the wrist area projecting toward the fingers and curving back towards the palm. The hook-like planar member has hook and loop material positioned on the back side that mates with hook and loop material located on the finger tips. In use the article to be held is positioned between the glove and hook-like member whereupon the hook-like member encompasses a part of the article to be held. Thereafter the fingers are curled until the mating hook and loop member are engaged thereby locking the gloves onto the article to be held. Additionally the present invention provides means for securing the glove onto the hand using an adjustable wrist strap.

The foregoing and other objects and advantages will appear from the description to follow. In the description reference is made to the accompanying drawings, which form a part hereof, and in which is shown by way of illustration-specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Figure 1:
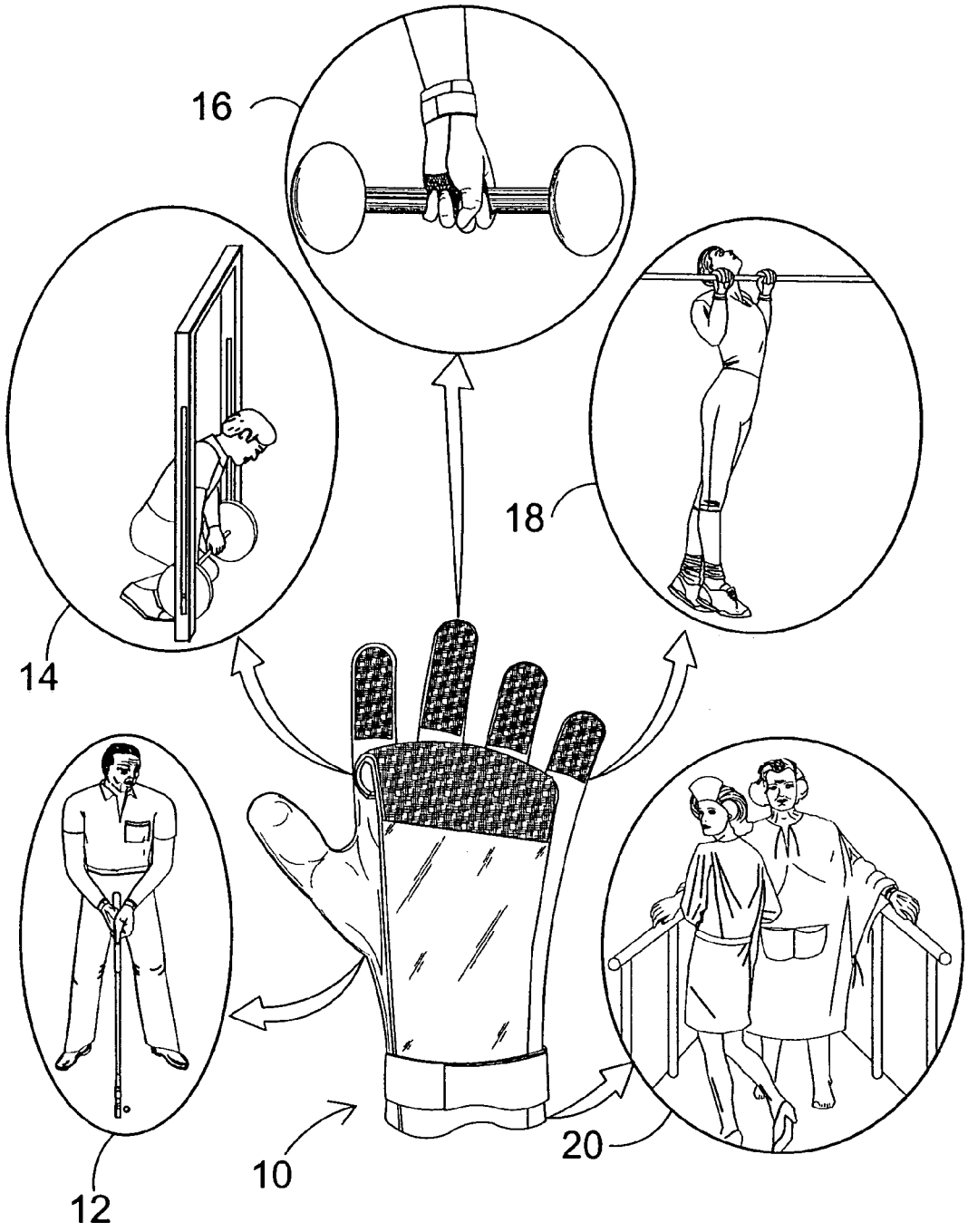
FIG. 1 is an illustrative view of the present invention in use.

Turning to FIG. 1, shown therein is an illustrative view of the present invention 10 in use. The present invention 10 discloses a glove having a pliable rigid element extending from the wrist portion of the glove having VELCRO®, i.e., hook and loop material, on one side, the glove having mating VELCRO on the palm side for engaging the pliable rigid element. The present invention 10 discloses a glove for gripping an article such as a bar comprising a clockwise and counter clockwise article gripping members with securing means for engaging and disengaging the article gripping members. Examples of use are golf 12, weight lifting 12, barbells 16, chin-ups 18 and physical therapy 20.

Figure 2:
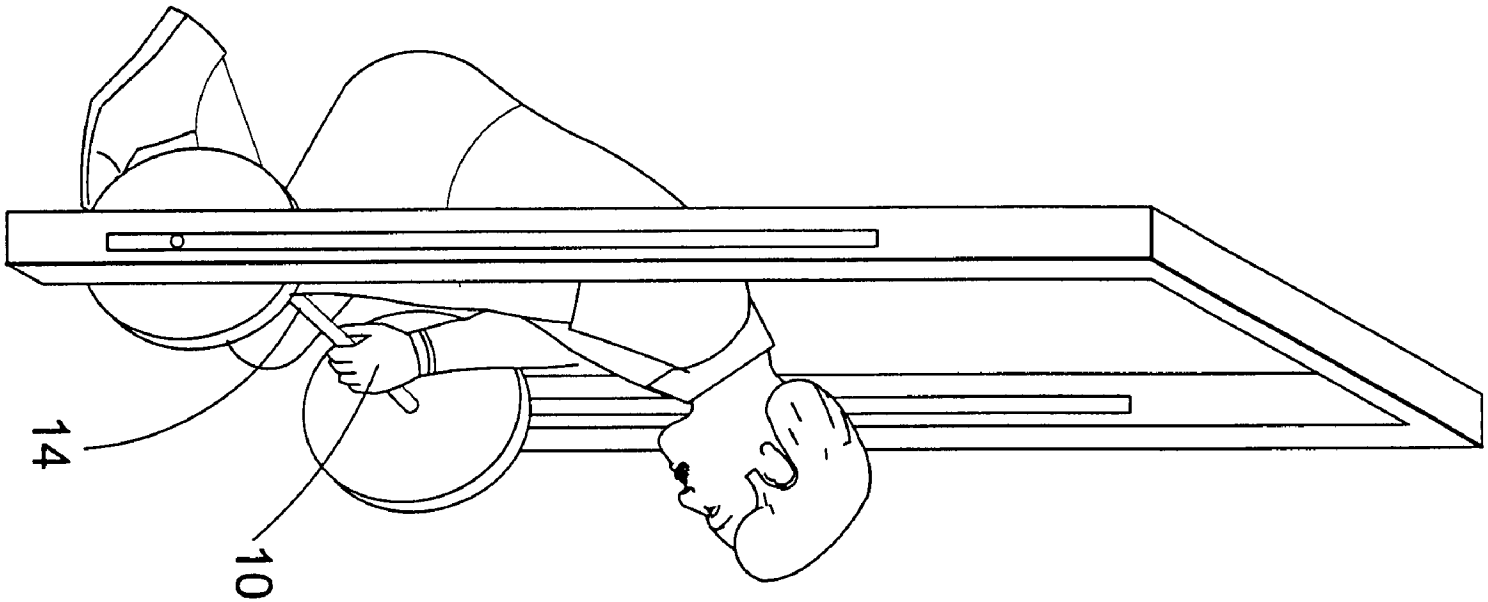
FIG. 2 is an illustrative view of the present invention in use.

Turing to FIG. 2, shown therein is an illustrative view of the present invention in use. The present invention 10 discloses a glove having a pliable rigid element extending from the wrist portion of the glove having VELCRO on one side, the glove having mating VELCRO on the palm side for engaging the pliable rigid element. The present invention 10 discloses a glove for gripping an article such as a weight lifting bar 14 comprising a clockwise and counter clockwise article gripping members with securing means for engaging and disengaging the article gripping members.

Figure 3:
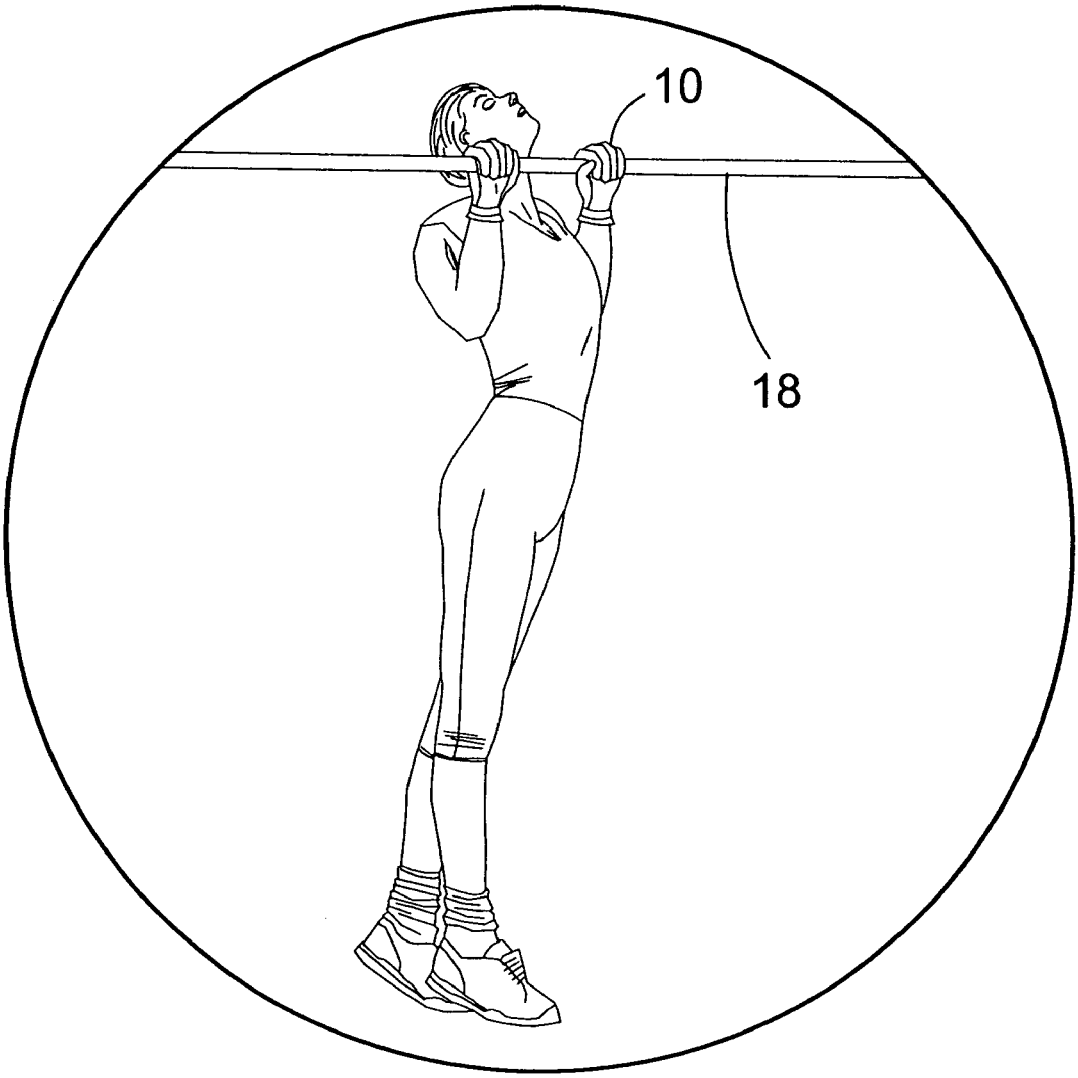
FIG. 3 is an illustrative view of the present invention in use.

Turning to FIG. 3, shown therein is an illustrative view of the present invention 10 in use. Shown is the present invention 10 disclosing a glove having a pliable rigid element extending from the wrist portion of the glove having VELCRO on one side, the glove having mating VELCRO on the palm side for engaging the pliable rigid element. The present invention 10 discloses a glove for gripping an article such as a chin-up bar 18 comprising a clockwise and counter clockwise article gripping members with securing means for engaging and disengaging the article gripping members.

Figure 4:
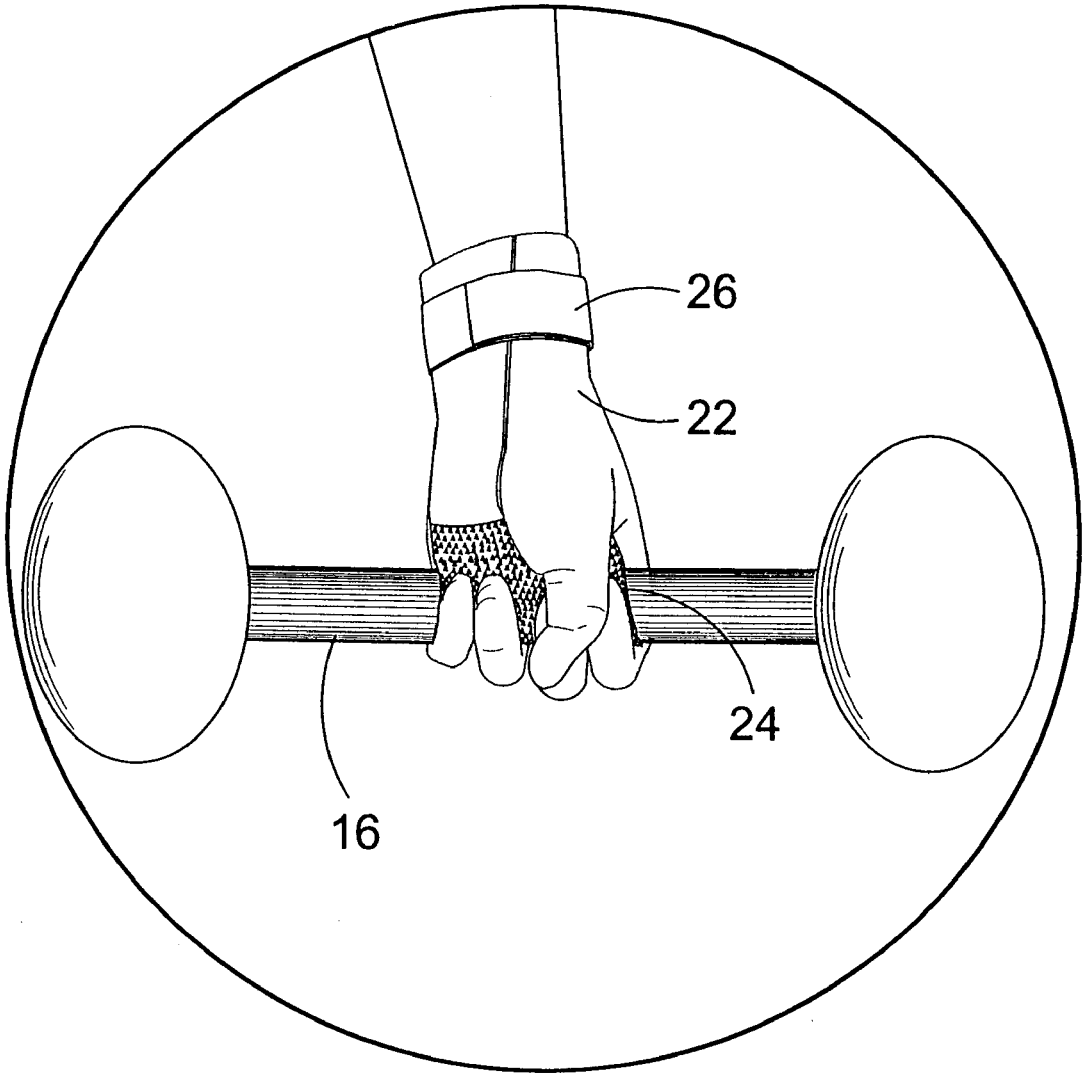
FIG. 4 is an illustrative view of the present invention in use.

Turning to FIG. 4, shown therein is an illustrative view of the present invention 10 in use. Shown is the present invention 10 disclosing a glove 22 having a pliable rigid element extending from the wrist portion of the glove having VELCRO on one side, the glove having mating VELCRO on the palm side for engaging the pliable rigid element. The present invention 10 discloses a glove 22 for gripping an article such as a barbell 16 comprising a clockwise and counter clockwise article gripping members with securing means 24 for engaging and disengaging the article gripping members. Also shown is adjusting strap 26.

Figure 5:
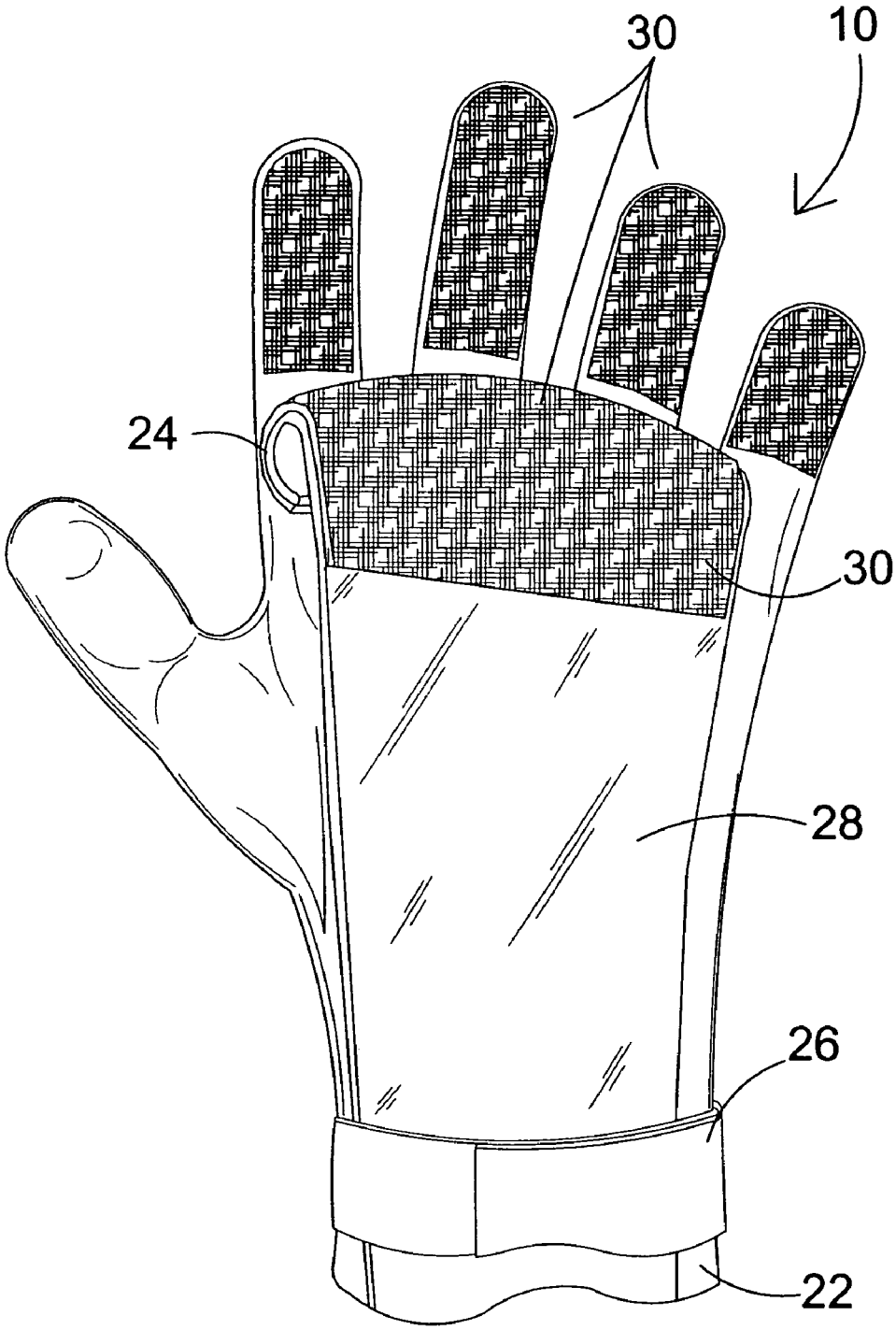
FIG. 5 is a perspective view of the present invention.

Turning to FIG. 5, shown therein is a perspective view of the present invention 10. Shown is a perspective view of the present invention 10 discloses a glove 22 having a pliable rigid element 28 extending from the wrist portion of the glove having VELCRO 30 on one side, the glove 22 having mating VELCRO on the palm side for engaging the pliable rigid element. The present invention 10 discloses a glove 22 for gripping an article such as a bar comprising a clockwise and counter clockwise article gripping members with securing means 24 for engaging and disengaging the article gripping members. Also shown is adjusting strap 26.

Figure 6:
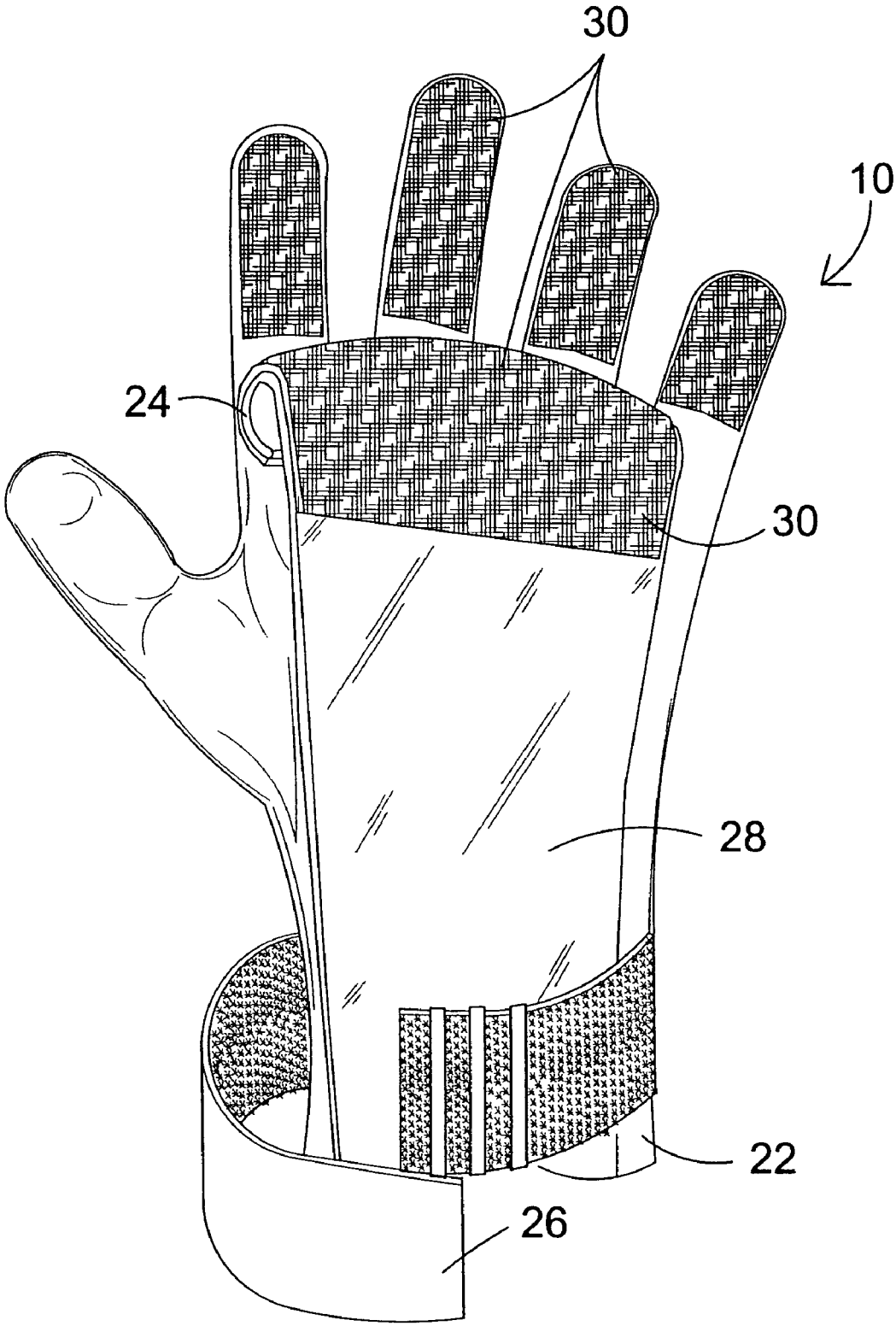
FIG. 6 is a perspective view of the present invention.

Turning to FIG. 6, shown therein is a perspective view of the present invention 10. Shown is a perspective view of the present invention 10 disclosing a glove 22 having a pliable rigid element 28 extending from the wrist portion of the glove having VELCRO 30 on one side, said glove having mating VELCRO on the palm side for engaging the pliable rigid element. The present invention 10 discloses a glove 22 for gripping an article such as a bar comprising a clockwise and counter clockwise article gripping members 24 with securing means for engaging and disengaging the article gripping members. Also shown is adjusting strap 26. Planar member 28 is complementarily sized to join to the palm side of the glove 22.

Figure 7:
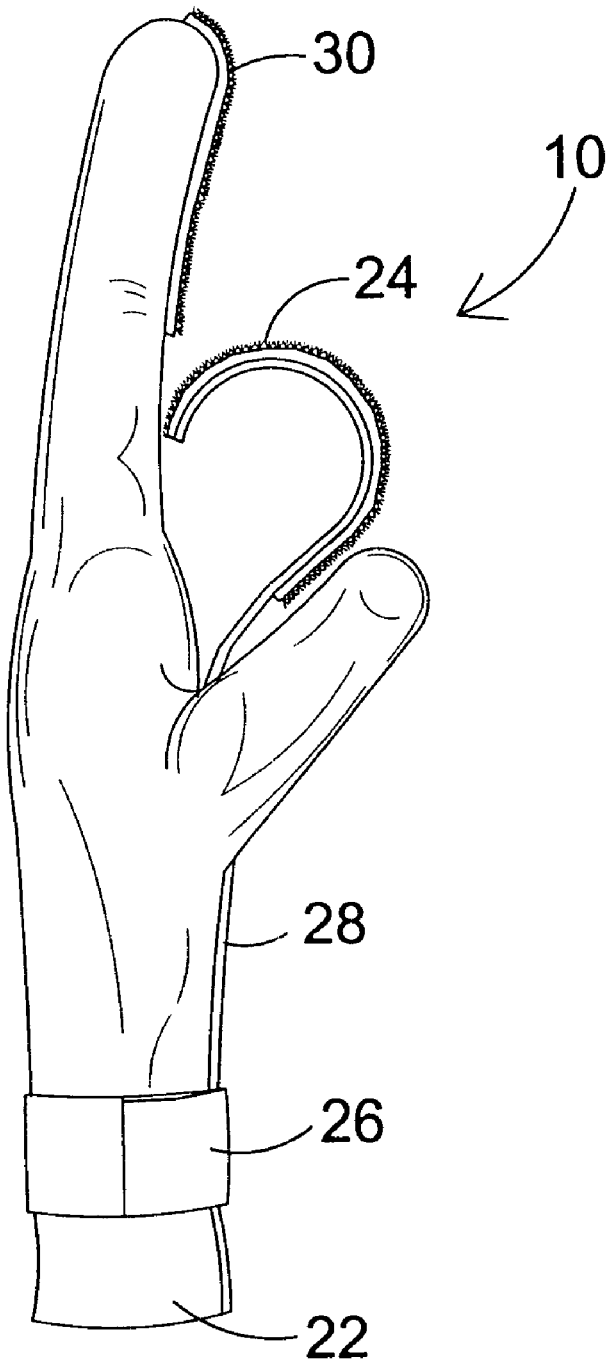
FIG. 7 is a side view of the present invention.

Turning to FIG. 7, shown therein is a side view of the present invention 10. Shown is a side view of the present invention 10 disclosing a glove 22 having a pliable rigid element 28 extending from the wrist portion of the glove having VELCRO 30 on one side, the glove having mating VELCRO on the palm side for engaging the pliable rid element. The present invention 10 discloses a glove 22 for gripping an article such as a bar comprising a clockwise and counter clockwise article gripping members 24 with securing means for engaging and disengaging the article gripping members. Also shown is adjusting strap 26. The glove 22 has a palm side and an outer or knuckle side, a wrist portion, a thumb portion, and multiple fingers each having a base and a tip.

Figure 8:
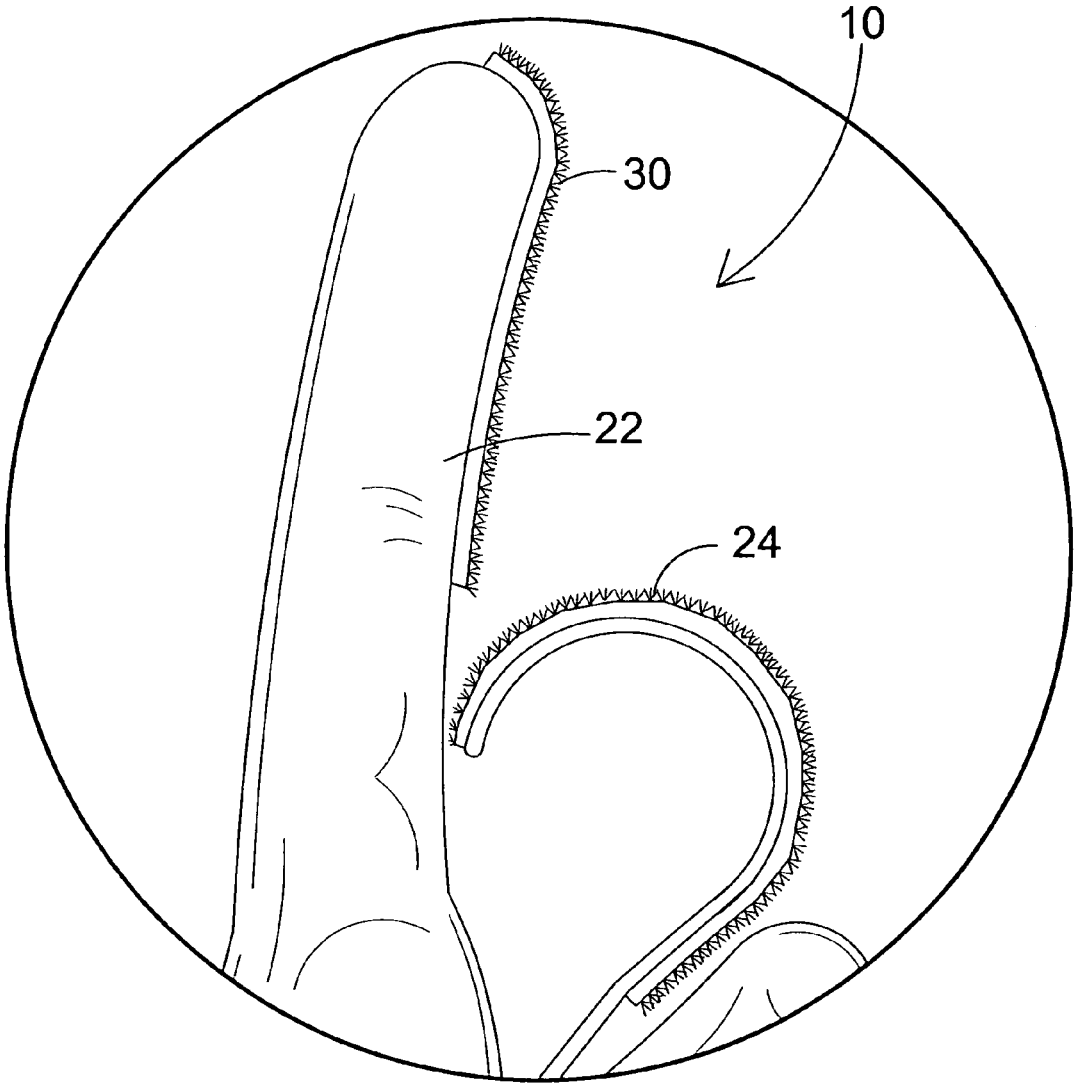
FIG. 8 is a detail view of the present invention.

Turning to FIG. 8, shown therein is a detail view of the present invention 10. Shown is a detail view of the present invention 10 disclosing a glove 22 having a pliable rigid element extending from the wrist portion of the glove having VELCRO 30 on one side the glove having mating VELCRO on the palm side for engaging the pliable rigid element. The present invention 10 discloses a glove 22 for gripping an article such as a bar comprising a clockwise and counter clockwise article gripping members 24 with securing means for engaging and disengaging the article gripping members.

Figure 9:
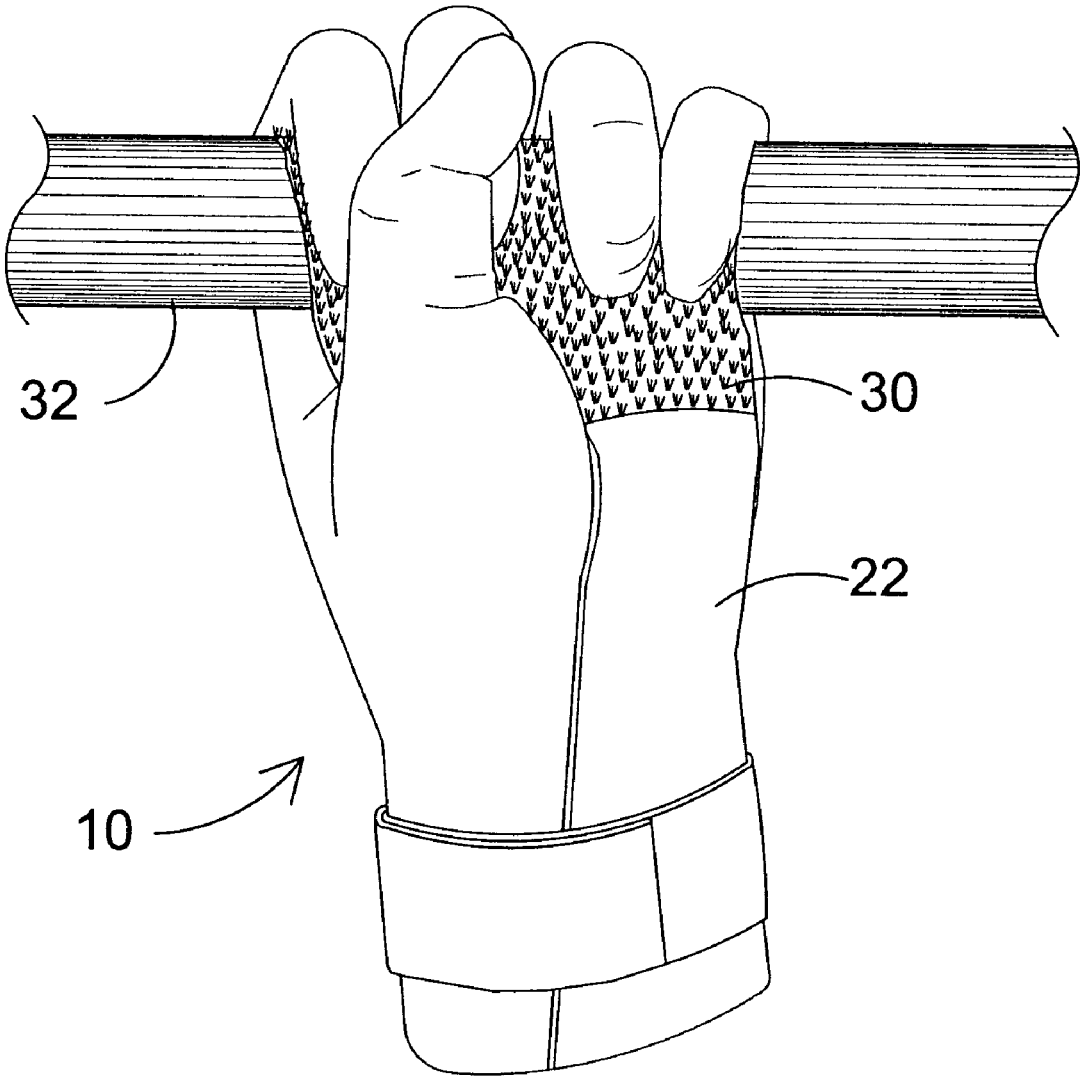
FIG. 9 is a detail view of the present invention.

Turning to FIG. 9, shown therein is a detail view of the present invention 10. Shown is a detail view of the present invention 10 discloses a glove 22 having a pliable rigid element extending from the wrist portion of the glove having VELCRO 30 on one side, the glove having mating VELCRO on the palm side for engaging the pliable rigid element. The present invention 10 discloses a glove 22 for gripping an article such as a cylindrical article or bar 32 comprising a clockwise and counter clockwise article gripping members with securing means for engaging and disengaging the article gripping members.

Figure 10:
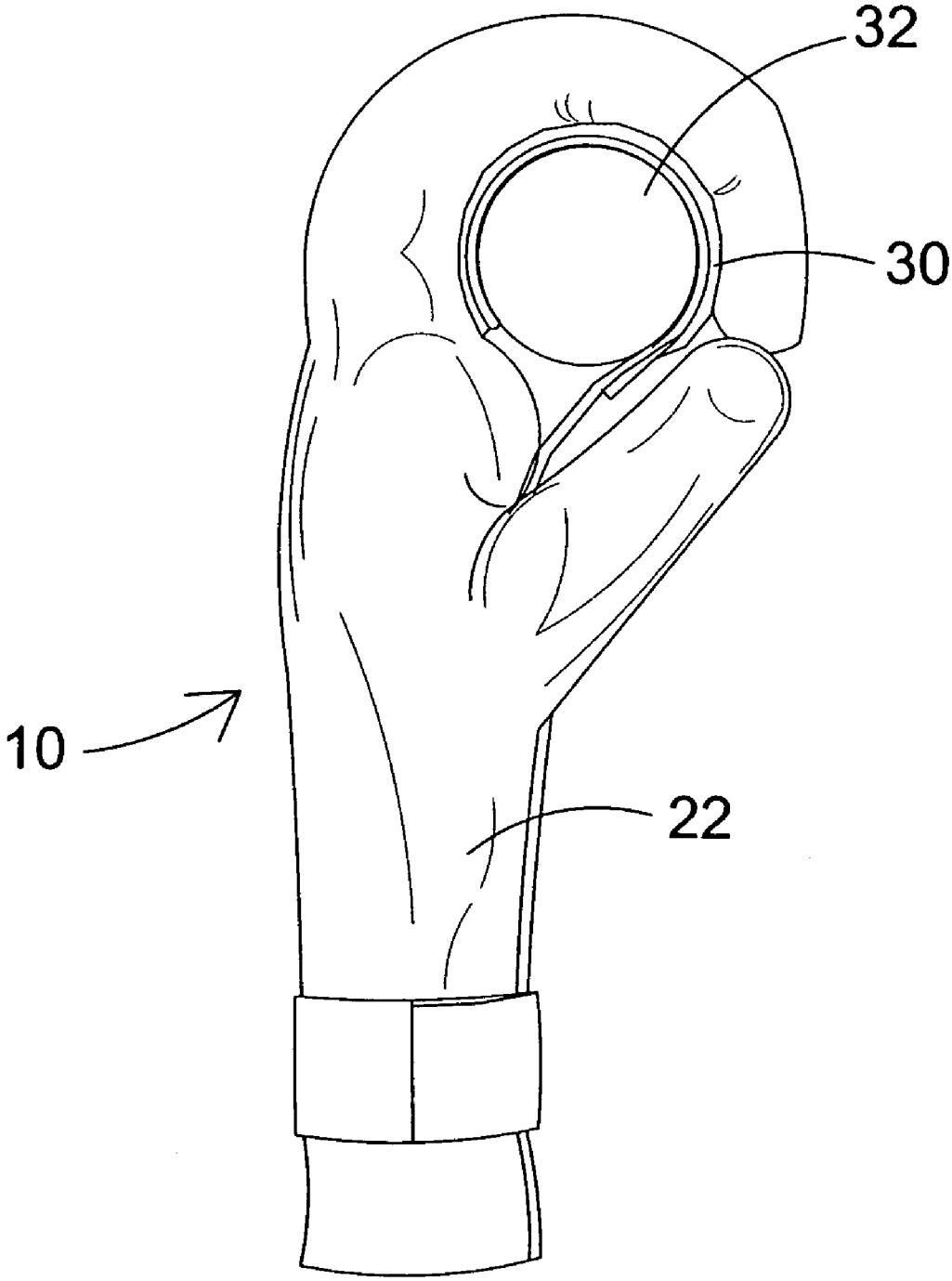
FIG. 10 is a detail view of the present invention.

Turning to FIG. 10, shown therein is a detail view of the present invention 10. Shown is a detail view of the present invention 10 disclosing a glove 22 having a pliable rigid element extending from the wrist portion of the glove having VELCRO 30 on one side, the glove having mating VELCRO on the palm side for engaging the pliable rigid element. The present invention 10 discloses a glove 22 for gripping an article such as a bar 32 comprising a clockwise and counter clockwise article gripping members with securing means for engaging and disengaging the article gripping members.

What is claimed to be new and desired to be protected by Letters Patent is set forth in the appended claims:

1. A glove for gripping a cylindrical article, comprising:

a) a glove having a palm side and an outer side, a wrist portion, a thumb portion, and multiple fingers for being worn on the hand of a user, each of said fingers having a base and a tip, said fingers being fully enclosed to fully enclose fingers of a user;

b) a planar member being disposed on said palm side of said glove, said member having first and second ends and first and second sides, wherein said first end is attached to said wrist portion of said palm side of said glove, wherein said first side is disposed toward said palm side of said glove, said first end of said planar member extending through the wrist portion of said glove;

c) wherein said planar member has a curved flap portion disposed on said second end thereof, wherein said flap portion curves toward said palm side of said glove, wherein said flap portion can be wrapped at least partially around the cylindrical article, wherein said first side of said flap portion is disposed toward the cylindrical article;

d) a first hook and loop material being disposed on said palm side of each said finger of said glove extending to distal ends of said multiple fingers;

e) a second mating hook and loop material being disposed on said second side of said flap portion up to the second end thereof so as to mate with said first hook and loop material so that said glove is locked to the cylindrical article; and f) a strap wrapped around the wrist portion of said glove including said planar member for securing said glove to the wrist of a user.

2. The glove of claim 1, wherein the length of said strap is adjustable so that the tension of said strap about the wrist of a user is adjustable.

3. The glove of claim 2, wherein said strap has first and second ends and first and second sides, wherein a first hook and loop material is disposed on said first side of said first end, wherein a second mating hook and loop material is disposed on said second side of said second end of said strap for mating to said first hook and loop material so that the length of the strap can be adjusted.

4. The glove of claim 3, wherein said planar member is complementarily sized as said palm of said glove.

5. The glove of claim 4, wherein said planar member is pliable to permit said planar member t to be wrapped around the cylindrical article.

6. The glove of claim 5, wherein said planar member is semi-rigid to permit said planar member to be secured around the cylindrical article.

7. The glove of claim 6, wherein said flap portion of said planar member is complementarily shaped as the cylindrical article so as to wrap around the cylindrical article.

8. The glove of claim 7, wherein said planar member extends from said wrist portion of said glove to said base of said fingers of said glove.

9. The glove of claim 8, wherein said flap portion is disposed adjacent said base of said fingers of said glove.

* * * * *